US011279576B2

(12) United States Patent
Matsushima

(10) Patent No.: US 11,279,576 B2
(45) Date of Patent: Mar. 22, 2022

(54) SHEET FEEDING APPARATUS AND IMAGE FORMING APPARATUS

(71) Applicant: CANON KABUSHIKI KAISHA, Tokyo (JP)

(72) Inventor: Akira Matsushima, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 160 days.

(21) Appl. No.: 16/718,877

(22) Filed: Dec. 18, 2019

(65) Prior Publication Data

US 2020/0207561 A1 Jul. 2, 2020

(30) Foreign Application Priority Data

Dec. 27, 2018 (JP) ..... JP2018-246301

(51) Int. Cl.

| | |
|---|---|
| ***B65H 1/14*** | (2006.01) |
| ***B65H 1/18*** | (2006.01) |
| ***B65H 29/22*** | (2006.01) |
| ***B65H 3/06*** | (2006.01) |

(52) U.S. Cl.

CPC ..... *B65H 1/14* (2013.01); *B65H 1/18* (2013.01); *B65H 3/0684* (2013.01); *B65H 29/22* (2013.01); *B65H 2301/42324* (2013.01)

(58) Field of Classification Search

CPC ..... B65H 11/02; B65H 23/28; B65H 1/18; B65H 1/14; B65H 1/08; B65H 2301/42324

See application file for complete search history.

(56) References Cited

U.S. PATENT DOCUMENTS

| | | | | |
|---|---|---|---|---|
| 5,215,299 | A * | 6/1993 | Luft | B65H 1/12 221/279 |
| 5,564,613 | A * | 10/1996 | Baldyga | B65H 23/28 242/615.3 |
| 7,971,868 | B2 | 7/2011 | Matsushima et al. | |
| 8,714,543 | B2 | 5/2014 | Matsushima et al. | |
| 8,783,677 | B2 | 7/2014 | Matsushima et al. | |
| 9,840,382 | B2 | 12/2017 | Okazaki et al. | |

(Continued)

FOREIGN PATENT DOCUMENTS

| | | |
|---|---|---|
| JP | 06-073001 U | 10/1994 |
| JP | 10-045264 A | 2/1998 |

(Continued)

OTHER PUBLICATIONS

Masato Suzuki et al., U.S. Appl. No. 16/703,967, filed Dec. 5, 2019.

*Primary Examiner* — Howard J Sanders

(74) *Attorney, Agent, or Firm* — Venable LLP

(57) ABSTRACT

A sheet feeding apparatus includes a sheet accommodating unit, a sheet feeding unit, a first lifting portion, a second lifting portion, and a linear member configured to liftably support the first lifting portion and the second lifting portion, and stretched between the first lifting portion and the second lifting portion on a lower side of the stacking surface. In addition, a first winding unit, a second winding unit, and an adjustment member adjust both a first distance of the linear member between the first winding unit and the first lifting portion and a second distance of the linear member between the second winding unit and the second lifting portion.

6 Claims, 14 Drawing Sheets

(56) References Cited

U.S. PATENT DOCUMENTS

| | | | | |
|---|---|---|---|---|
| 10,233,041 | B2 | 3/2019 | Okazaki et al. | |
| 2011/0024970 | A1 | 2/2011 | Uchida et al. | |
| 2014/0125005 | A1 | 5/2014 | Matsushima et al. | |
| 2020/0130968 | A1 * | 4/2020 | Solders ..... | B65H 1/14 |

FOREIGN PATENT DOCUMENTS

| | | | | |
|---|---|---|---|---|
| JP | 10-291656 | A | | 11/1998 |
| JP | 2008081245 | A | * | 4/2008 |
| JP | 2009249175 | A | * | 10/2009 |
| JP | 2014-91615 | A | | 5/2014 |

* cited by examiner

SHEET FEEDING APPARATUS AND IMAGE FORMING APPARATUS

BACKGROUND OF THE INVENTION

Field of the Invention

The present invention relates to a sheet feeding apparatus in which a sheet stacking portion is raised by winding a linear member, and an image forming apparatus.

Description of the Related Art

Hitherto, an image forming apparatus such as a printer, a copying machine, and a facsimile is provided with a sheet feeding apparatus that feeds a sheet to an image forming unit. Such a sheet feeding apparatus stacks a sheet on a sheet tray elevatably provided on a feeding deck, raises the uppermost sheet to a position where the uppermost sheet can be fed by a feed roller, and feeds the sheet to an image forming unit by the feed roller. Further, when a sensor or the like detects that the position of the uppermost sheet in the sheet tray is lowered due to the feeding of the sheet, the sheet tray is raised again, so that the uppermost sheet is located at the position where the uppermost sheet can be fed. When the sheet is stacked on the sheet tray, the sheet tray is lowered such that the sheet can be easily stacked.

In this way, a structure in which the sheet tray is raised by winding a wire which is a linear member (see Japanese Laid-Open Patent Publication No. 2014-91615) has been proposed as a structure for elevating the sheet tray. In detail, two winding drums driven in conjunction with one motor are provided on one side and the other side of the sheet tray in a sheet width direction, and the one side and the other side of the sheet tray in the sheet width direction are simultaneously lifted up with wires, so that the sheet tray is raised substantially horizontally.

However, unless accuracy of components such as the wires and the winding drums on the one side and the other side of the sheet tray in the sheet width direction is managed with high accuracy, the sheet tray may be tilted with respect to the horizontal direction. When the sheet tray is tilted, one of both ends of the uppermost sheet in the sheet width direction is raised, and even when the height of the uppermost sheet facing the feed roller is located at an appropriate position, any end portion becomes higher than the appropriate height. As a result, the raised end portion of the sheet comes into contact with a lower surface of a sheet feed unit having the feed roller, which may cause feeding failure and an oblique movement.

Therefore, a space is provided between a position where the uppermost sheet can be fed and the lower surface of the sheet feed unit so that the sheet does not come into contact with the lower surface of the sheet feed unit. However, there is a problem in that the height of the entire apparatus is increased to that extent. On the other hand, in order to reduce occurrence of the feeding failure and the oblique movement, it may be considered that the accuracy of the components such as the wires and the winding drums is managed with high accuracy. However, there is a problem in that component costs and manufacturing costs increase.

SUMMARY OF THE INVENTION

According to a first aspect of the present invention, a sheet feeding apparatus includes a sheet accommodating unit configured to elevatably support a sheet stacking portion having a stacking surface on which a sheet is stacked, a sheet feeding unit configured to feed the sheet stacked on the sheet stacking portion, a first lifting portion provided in the sheet stacking portion and disposed on one side in a sheet width direction perpendicular to a sheet feeding direction, a second lifting portion provided in the sheet stacking portion and disposed on the other side in the sheet width direction, a linear member configured to liftably support the first lifting portion and the second lifting portion, the linear member being stretched between the first lifting portion and the second lifting portion on a lower side of the stacking surface, a first winding unit configured to lift the sheet stacking portion by winding the linear member supporting the first lifting portion, a second winding unit configured to lift the sheet stacking portion by winding the linear member supporting the second lifting portion, and an adjustment member having an engagement portion that engages with a fixture fixed to the linear member on the lower side of the stacking surface and is movable to a plurality of different positions in the sheet width direction and a fixing portion that fixes the engagement portion at one of the plurality of positions, and configured to adjust both a first distance of the linear member between the first winding unit and the first lifting portion and a second distance of the linear member between the second winding unit and the second lifting portion.

According to a second aspect of the present invention, a sheet feeding apparatus includes a sheet accommodating unit configured to elevatably support a sheet stacking portion having a stacking surface on which a sheet is stacked, a sheet feeding unit configured to feed the sheet stacked on the sheet stacking portion, a first lifting portion provided in the sheet stacking portion and disposed on one side in a sheet width direction perpendicular to a sheet feeding direction, a second lifting portion provided in the sheet stacking portion and disposed on the other side in the sheet width direction, a linear member configured to liftably support the first lifting portion and the second lifting portion, the linear member being stretched between the first lifting portion and the second lifting portion on a lower side of the stacking surface, a first winding unit configured to lift the sheet stacking portion by winding the linear member supporting the first lifting portion, a second winding unit configured to lift the sheet stacking portion by winding the linear member supporting the second lifting portion, a first adjustment tool disposed on the lower side of the stacking surface and fixed to the sheet stacking portion on one side in the sheet width direction with respect to a positioning hold portion of the sheet stacking portion, which holds and positions a fixture fixed to the linear member, the first adjustment tool being configured to change a path length of the linear member from the positioning hold portion to the first winding unit, and a second adjustment tool fixed to the sheet stacking portion on the other side in the sheet width direction with respect to the positioning hold portion, the second adjustment tool being configured to change a path length of the linear member from the positioning hold portion to the second lifting portion.

According to a third aspect of the present invention, a sheet feeding apparatus includes a sheet accommodating unit configured to elevatably support a sheet stacking portion having a stacking surface on which a sheet is stacked, a sheet feeding unit configured to feed the sheet stacked on the sheet stacking portion, a first lifting portion provided in the sheet stacking portion and disposed on one side in a sheet width direction perpendicular to a sheet feeding direction, a second lifting portion provided in the sheet stacking portion and disposed on the other side in the sheet width direction, a first linear member configured to liftably support the first lifting portion and extend to a lower side of the stacking surface of the sheet stacking portion through the first lifting portion, a second linear member configured to liftably support the second lifting portion and extend to the lower side of the stacking surface of the sheet stacking portion through the second lifting portion, a first winding unit configured to lift the sheet stacking portion by winding the first linear member, a second winding unit configured to lift the sheet stacking portion by winding the second linear member, a first fixing portion disposed on the lower side of the stacking surface of the sheet stacking portion and configured to fix an end portion of the first linear member to the sheet stacking portion in such a manner that a path length of the first linear member from the end portion of the first linear member to the first lifting portion can change, and a second fixing portion disposed on the lower side of the stacking surface of the sheet stacking portion and configured to fix an end portion of the second linear member to the sheet stacking portion in such a manner that a path length of the second linear member from the end portion of the second linear member to the second lifting portion can change.

Further features of the present invention will become apparent from the following description of exemplary embodiments with reference to the attached drawings.

DESCRIPTION OF THE EMBODIMENTS

First Embodiment

Hereinafter, a first embodiment will be described with reference to FIGS. 1 to 9.

Entire Configuration

Figure 1:
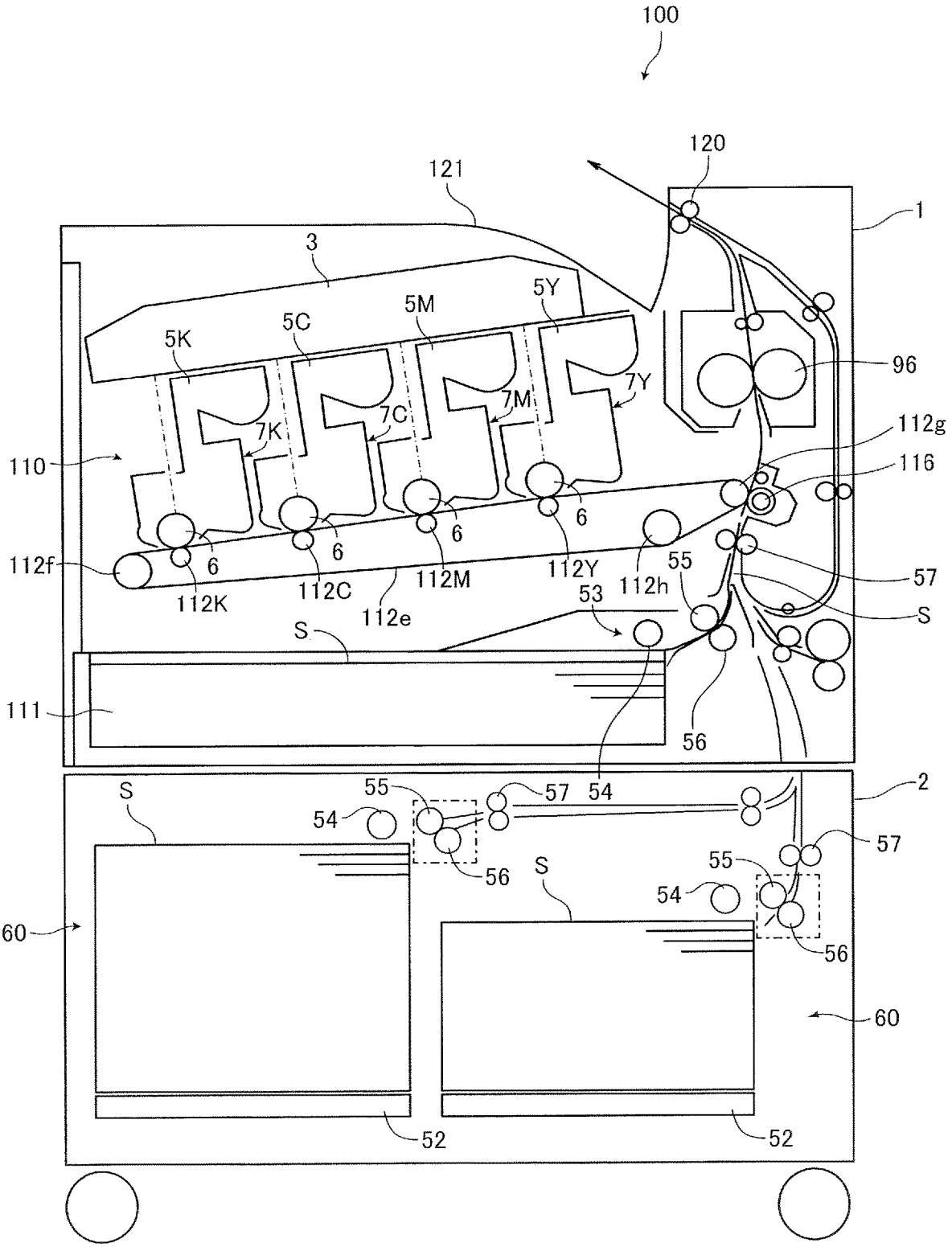
FIG. 1 is an overall schematic view illustrating an image forming apparatus according to a first embodiment.

First, a printer 100 as an image forming apparatus according to the first embodiment will be described. As illustrated in FIG. 1, the printer 100 is a laser beam printer of an electrophotographic system, and is provided with a printer body 1 and a sheet feeding apparatus 2 which is connected to a lower portion of the printer body 1 and on which the sheet is stacked.

The printer body 1 includes a sheet feeding cassette 111 that stacks and stores a sheet S, an image forming unit 110 that forms an image on the sheet S, a fixing section 96 that fixes the image onto the sheet S, and the like. A sheet discharge tray 121 on which the discharged sheet S is stacked is provided at an upper portion of the printer body 1.

The image forming unit 110 is a so-called four-drum full-color image forming unit that includes a laser scanner 3, four process cartridges 7Y, 7M, 7C, and 7K, and an intermediate transfer belt 112*e*. These process cartridges 7Y, 7M, 7C, and 7K form toner images of yellow (Y), magenta (M), cyan (C), and black (K), respectively, and have the same configuration except for the colors of the toner images. The process cartridges 7 have photosensitive drums 6, respectively, and toner cartridges 5Y, 5M, 5C, and 5K that accommodate toners of the colors are provided above the photosensitive drums 6, respectively, and are detachably attached to the printer body 1.

The intermediate transfer belt 112*e* is wound on a drive roller 112*f*, a secondary transfer counter roller 112*g*, a tension roller 112*h*, and the like, and is disposed below the four process cartridges 7Y, 7M, 7C, and 7K. The intermediate transfer belt 112*e* is disposed to be in contact with the photosensitive drums 6 of the process cartridges 7Y, 7M, 7C, and 7K, and is rotationally driven by the drive roller 112*f* in a counterclockwise direction. Further, four primary transfer rollers 112Y, 112M, 112C, and 112K that abut on the inner peripheral surface of the intermediate transfer belt 112*e* at positions facing the photosensitive drums 6 are provided inside the intermediate transfer belt 112*e*. Further, the image forming unit 110 includes a secondary transfer roller 116 that abuts on the outer peripheral surface of the intermediate transfer belt 112*e* at a position facing the secondary transfer counter roller 112*g*.

Next, an image forming operation of the printer body 1 as configured above will be described. When image data transmitted from a personal computer that is not illustrated is input to the laser scanner 3, the photosensitive drums 6 of the process cartridges 7 are irradiated with a laser beam corresponding to the image data from the laser scanner 3.

At this time, the surface of the photosensitive drum 6 is uniformly charged to a predetermined polarity and potential in advance by a charging roller (not illustrated), and an electrostatic latent image is formed on the surface as the surface and is irradiated with the laser beam from the laser scanner 3. The electrostatic latent image formed on the photosensitive drum 6 is developed by a developing roller (not illustrated), and a toner image of each color is formed on the photosensitive drum 6.

The toner images of the respective colors formed on the respective photosensitive drums 6 are transferred to the intermediate transfer belt 112*e* by the primary transfer rollers 112Y, 112M, 112C, and 112K, and are conveyed to the secondary transfer roller 116 by the intermediate transfer belt 112*e* rotated by the drive roller 112E An image forming process of each color is performed at a timing when an upstream toner image primarily transferred onto the intermediate transfer belt 112*e* is superimposed between the photosensitive drums 6 and the primary transfer rollers 112Y, 112M, 112C, and 112K.

While this image forming process is performed, the sheet S stacked and accommodated in the sheet feeding cassette 111 of the printer body 1 or a sheet storage portion 60 of the sheet feeding apparatus 2 is fed by a pickup roller 54 of a sheet feeding unit 53 in a feeding direction. The sheets S fed by the pickup roller 54 are separated from each other one by one by a feed roller 55 and a retard roller 56 and are conveyed to the secondary transfer roller 116 by a conveyance roller pair 57. The full-color toner image on the intermediate transfer belt 112*e* is transferred onto the sheet S conveyed to the secondary transfer roller 116 by a secondary transfer bias applied to the secondary transfer roller 116. The sheet S onto which the toner image is transferred is applied with a predetermined heat and a predetermined pressure by the fixing section 96, and the toner image is fixed by melting and fixing the toner. The sheet S passing through the fixing section 96 is discharged to the sheet discharge tray 121 by a sheet discharge roller pair 120.

Configuration of Sheet Feeding Apparatus

Next, the sheet feeding apparatus 2 will be described in detail. As illustrated in FIG. 1, the sheet feeding apparatus 2 includes the sheet feeding unit 53 as a sheet feeding unit and the sheet storage portion 60 which serves as a feeding deck as a sheet accommodating unit and in which the sheet is stacked and stored. The sheet feeding unit 53 has the pickup roller 54, the feed roller 55, the retard roller 56, the conveyance roller pair 57, and the like (see FIG. 1), which have been described above. Further, the sheet storage portion 60 is supported to be pulled out from an apparatus body of the sheet feeding apparatus 2 through a slide rail that is not illustrated, and is configured such that a worker can supply the sheet in a pulled-out state in which the sheet storage portion 60 is pulled out from the apparatus body.

Figure 3:
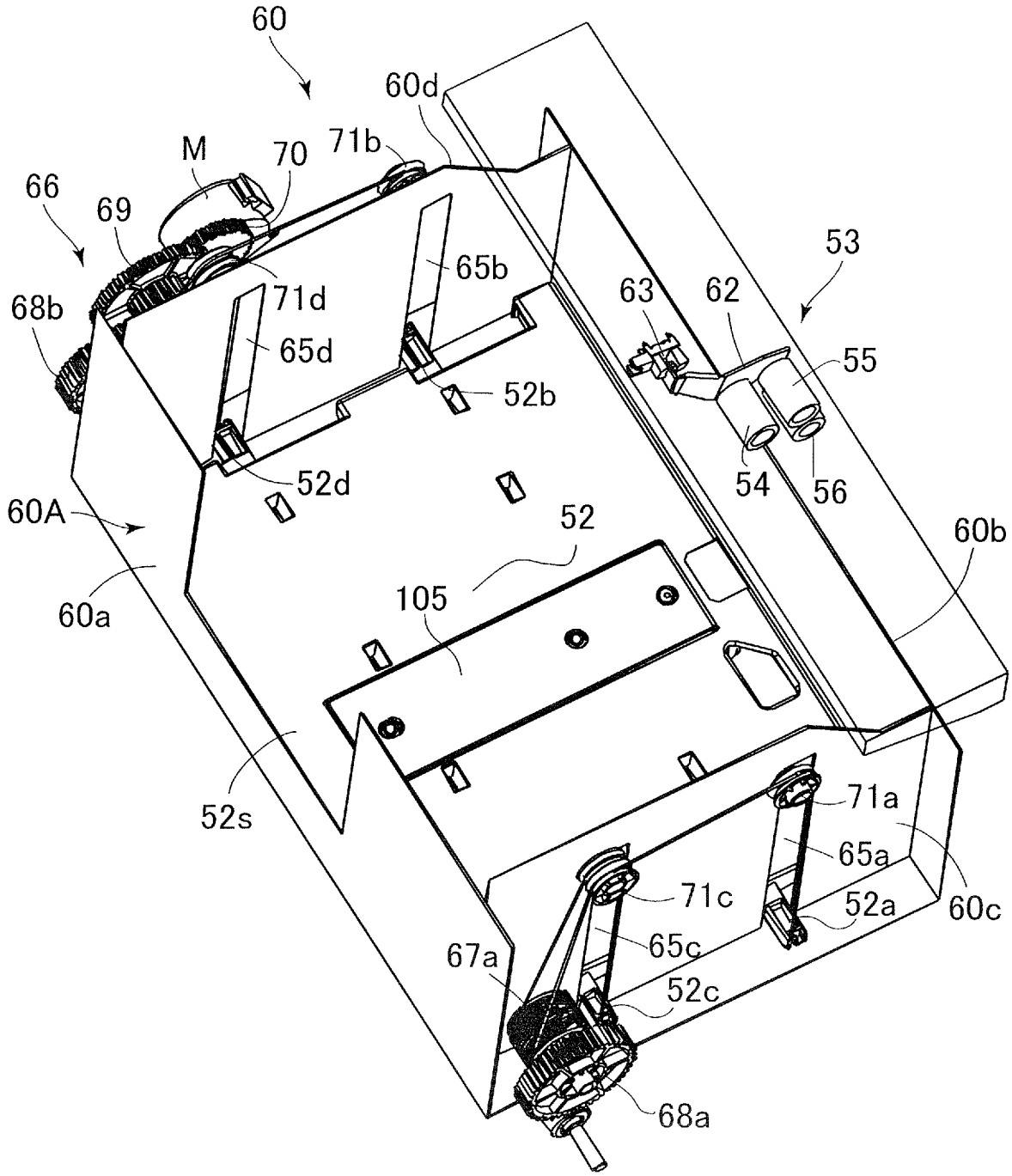
FIG. 3 is an upper perspective view illustrating the sheet storage case according to the first embodiment.

As illustrated in FIG. 3, the sheet storage portion 60 roughly includes a sheet storage portion body 60A and a sheet stacking base 52 as a sheet stacking portion, which is elevatably supported on the sheet storage portion body 60A and has a sheet supporting surface 52A on which the sheet can be stacked. The sheet storage portion body 60A has a wall portion 60*a* provided on an upstream side in a sheet feeding direction in which the sheet S is fed, a wall portion 60*b* provided on a downstream side in the sheet feeding direction, and wall portions 60*c* and 60*d* provided on opposite sides in a sheet width direction perpendicular to the sheet feeding direction. A sheet storage space for storing the sheet S is formed by these wall portions 60*a*, 60*b*, 60*c*, and 60*d*. The sheet stacking base 52 on which the sheet S is stacked is disposed inside the sheet storage space.

Figure 4:
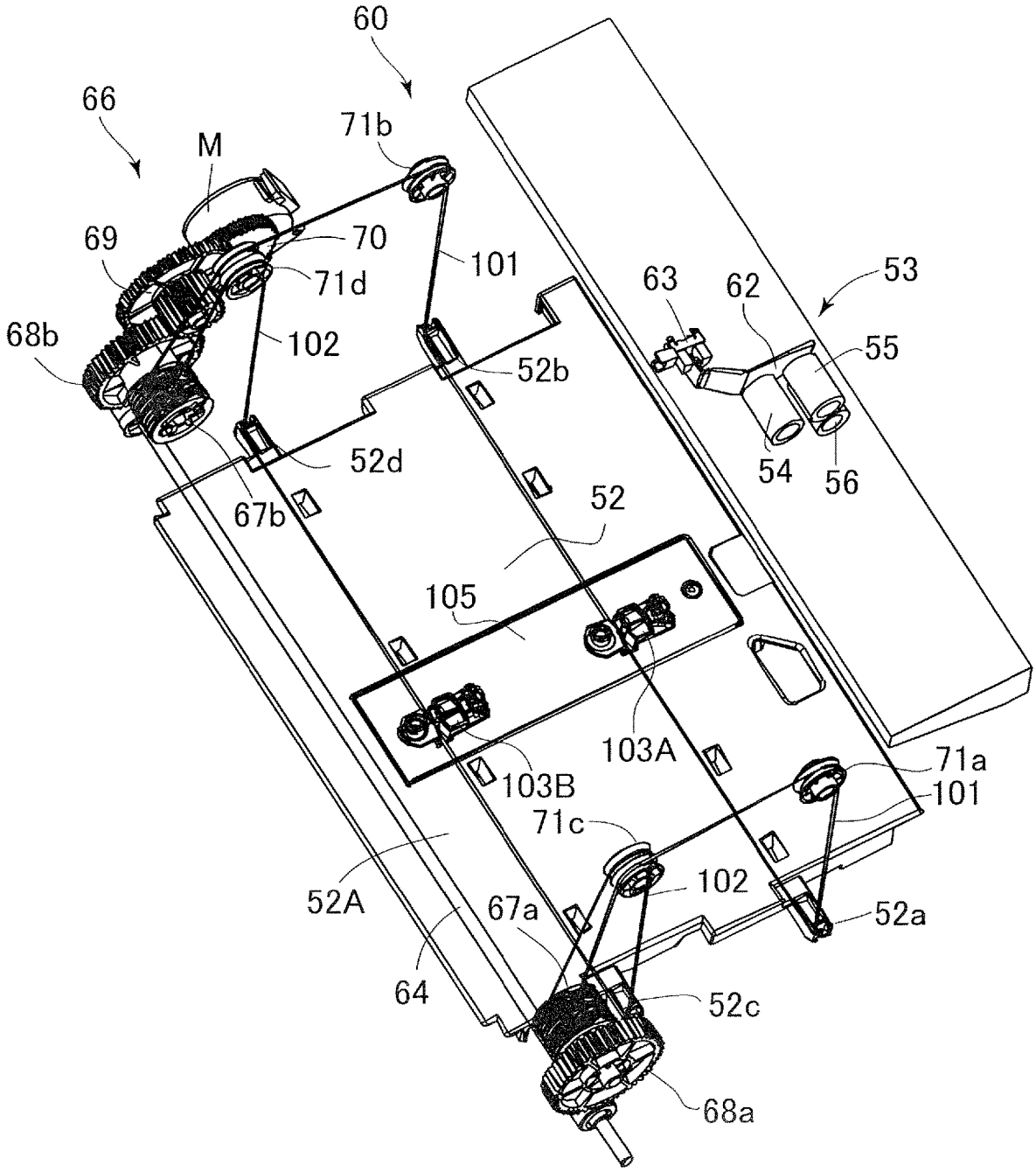
FIG. 4 is an upper perspective view illustrating a state in which a sheet stacking base according to the first embodiment is lowered.
Figure 5:
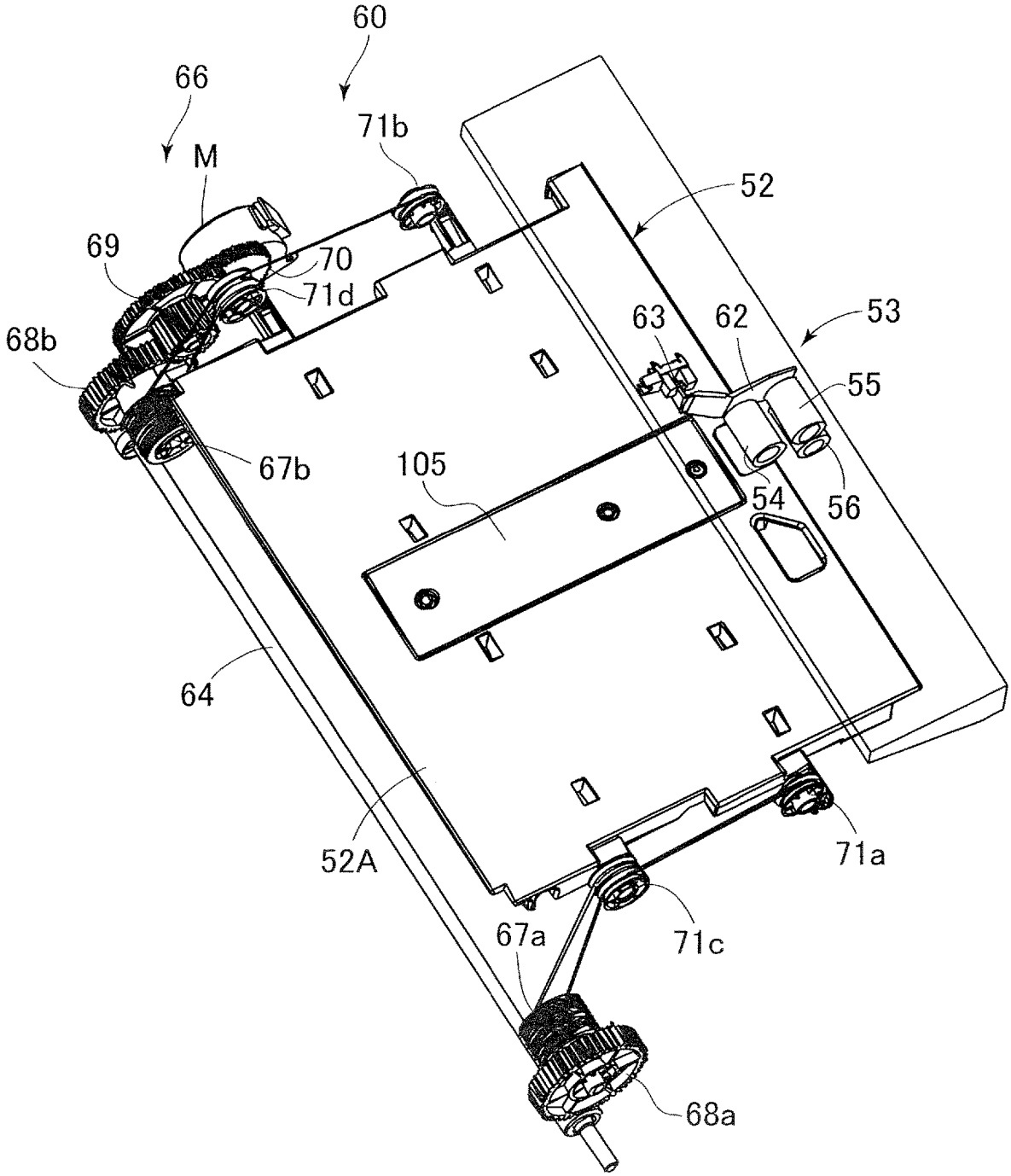
FIG. 5 is an upper perspective view illustrating a state in which the sheet stacking base according to the first embodiment is raised.

Further, the sheet storage portion body 60A has an elevation mechanism 66 disposed on opposite sides outside the wall portions 60*c* and 60*d* in the sheet width direction. On the other hand, as illustrated in FIGS. 4 and 5, the sheet stacking base 52 is formed in a substantially rectangular shape in plan view. The sheet stacking base 52 has lifting portions 52*a* and 52*b* lifted up by a wire 101 and lifting portions 52*c* and 52*d* lifted up by a wire 102, the lifting portions 52*a*, 52*b*, 52*c*, and 52*d* being provided to extend outward from opposite sides in the sheet width direction. That is, the lifting portions 52*a* and 52*c*, which are first lifting portions, are arranged on one side in the sheet width direction with respect to the sheet S stacked on the sheet stacking base 52. Further, the lifting portions 52*b* and 52*d*, which are the second lifting portions, are arranged on the other side in the sheet width direction with respect to the sheet stacked on the sheet stacking base 52. The sheet stacking base 52 is suspended, i.e. lifted up, by the wires 101 and 102 through the lifting portions 52*a*, 52*b*, 52*c*, and 52*d* in this embodiment. That is, the wire 101 liftably supports (suspends) the lifting portions 52*a* and 52*c* and the wire 102 liftably supports (suspends) the lifting portions 52*c* and 52*d*. Further, the lifting portion 52*a* is disposed downstream of the lifting portion 52*c* in the sheet feeding direction as a third lifting portion. In contrast, the lifting portion 52*c* is disposed upstream of the lifting portion 52*a* in the sheet feeding direction as a first lifting portion. The lifting portion 52*b* is disposed downstream of the lifting portion 52*d* in the sheet feeding direction as a fourth lifting portion. In contrast, the lifting portion 52*d* is disposed upstream of the lifting portion 52*c* in the sheet feeding direction as a second lifting portion. The tip ends of these lifting portions 52*a*, 52*b*, 52*c*, and 52*d* are disposed to protrude outward from groove portions 65*a*, 65*b*, 65*c*, and 65*d* provided in the above-described wall portions 60*a*, 60*b*, 60*c*, and 60*d* illustrated in FIG. 3.

The elevation mechanism 66 is a mechanism for elevating the sheet stacking base 52 by a driving force of a lifter motor M as a driving unit. That is, as illustrated in FIGS. 4 and 5, the elevation mechanism 66 includes a drive gear 70, a drive gear 69, drum gears 68*a* and 68*b*, a connection shaft 64, a winding drums 67*a* and 67*b*, pulleys 71*a*, 71*b*, 71*c*, and 71*d*, and the wires 101 and 102. Among them, the lifter motor M, the drive gear 70, and the drive gear 69 are provided on a main body side of the sheet feeding apparatus 2. Further, the sheet storage portion body 60A includes the drum gears 68*a* and 68*b*, the connection shaft 64, the winding drums 67*a* and 67*b*, the pulleys 71*a*, 71*b*, 71*c*, and 71*d*, and the wires 101 and 102. That is, when the sheet storage portion body 60A is inserted and stored into the sheet feeding apparatus 2, the drive gear 69 and the drum gear 68*b* are engaged with each other and are drivingly connected to each other.

The drive gear 70 is connected to an output shaft of the lifter motor M, and the drive gear 70 is engaged with the drive gear 69. Further, the drive gear 69 is engaged with the drum gear 68*b*, and the drum gear 68*b* and the drum gear 68*a* are drivingly connected to each other through the connection shaft 64. Further, the drum gear 68*b* is integrally connected to the winding drum 67*b*, and the drum gear 68*a* is integrally connected to the winding drum 67*a*.

One end portion of each of the wires 101 and 102 which are linear members is wound on the winding drum 67*a*, and the other end portion of each of the wires 101 and 102 is wound on the winding drum 67*b*. The wire 101 wound on the winding drum 67*a* supports the lifting portion 52*a* via the pulley 71*a* disposed above the lifting portion 52*a*. Further, the wire 102 wound on the winding drum 67*a* supports the lifting portion 52*c* via the pulley 71*c* disposed above the lifting portion 52*c*. Further, the wire 101 wound on the winding drum 67*b* supports the lifting portion 52*b* via the pulley 71*b* disposed above the lifting portion 52*b*. The wire 102 wound on the winding drum 67*b* supports the lifting portion 52*d* via the pulley 71*d* disposed above the lifting portion 52*d*. That is, the wires 101 and 102 are arranged to be connected to each other through a lower side of the sheet supporting surface 52A of the sheet stacking base 52, and are connected to the winding drum 67*a* and the winding drum 67*b*. In other words, each of the wires 101 and 102 are stretched on a lower side of the sheet supporting surface 52A of the sheet stacking base 52. The drum gear 68*a* and the winding drum 67*a* constitute a first winding unit disposed on one side in the sheet width direction, and the drum gear 68*b* and the winding drum 67*b* constitute the second winding unit disposed on the other side in the sheet width direction. Further, the wire 101 is a second linear member supporting the lifting portions 52*a* and 52*b* to lift up a downstream side of the sheet stacking base 52 in the sheet feeding direction. The wire 102 is a first linear member supporting the lifting portions 52*c* and 52*d* to lift an upstream side of the sheet stacking base 52 in the sheet feeding direction. In the present embodiment, one side of each of the wires 101 and 102 is wound on the winding drum 67*a*, and the other side of each of the wires 101 and 102 is wound on the winding drum 67*b*. However, first winding unit may be configured such that the one side of each of the wires 101 and 102 is wound on a separate winding drum, and the second winding unit may be configured such that the other side of each of the wires 101 and 102 is wound on a separate winding drum.

On the other hand, the sheet feeding apparatus 2 has a top surface (not illustrated) that is disposed above the pickup roller 54 in a storage state of the sheet storage portion 60 and covers an upper side of the sheet supporting surface 52A. The sheet feeding apparatus 2 has a flag member 62 which is disposed below the top surface and near the pickup roller 54 and pivots when the flag member 62 comes into contact with the uppermost sheet stacked on the sheet supporting surface 52A. The sheet feeding apparatus 2 has a sheet detection sensor 63 which detects a predetermined feeding height, at which the uppermost sheet can be fed by the pickup roller 54, by being shielded from light by the flag member 62. The pickup roller 54 is disposed to be located at a downstream end portion in the sheet feeding direction and at a central portion in the sheet width direction with respect to the sheet supporting surface 52A that is elevated.

Operation of Sheet Feeding Apparatus

Figure 2:
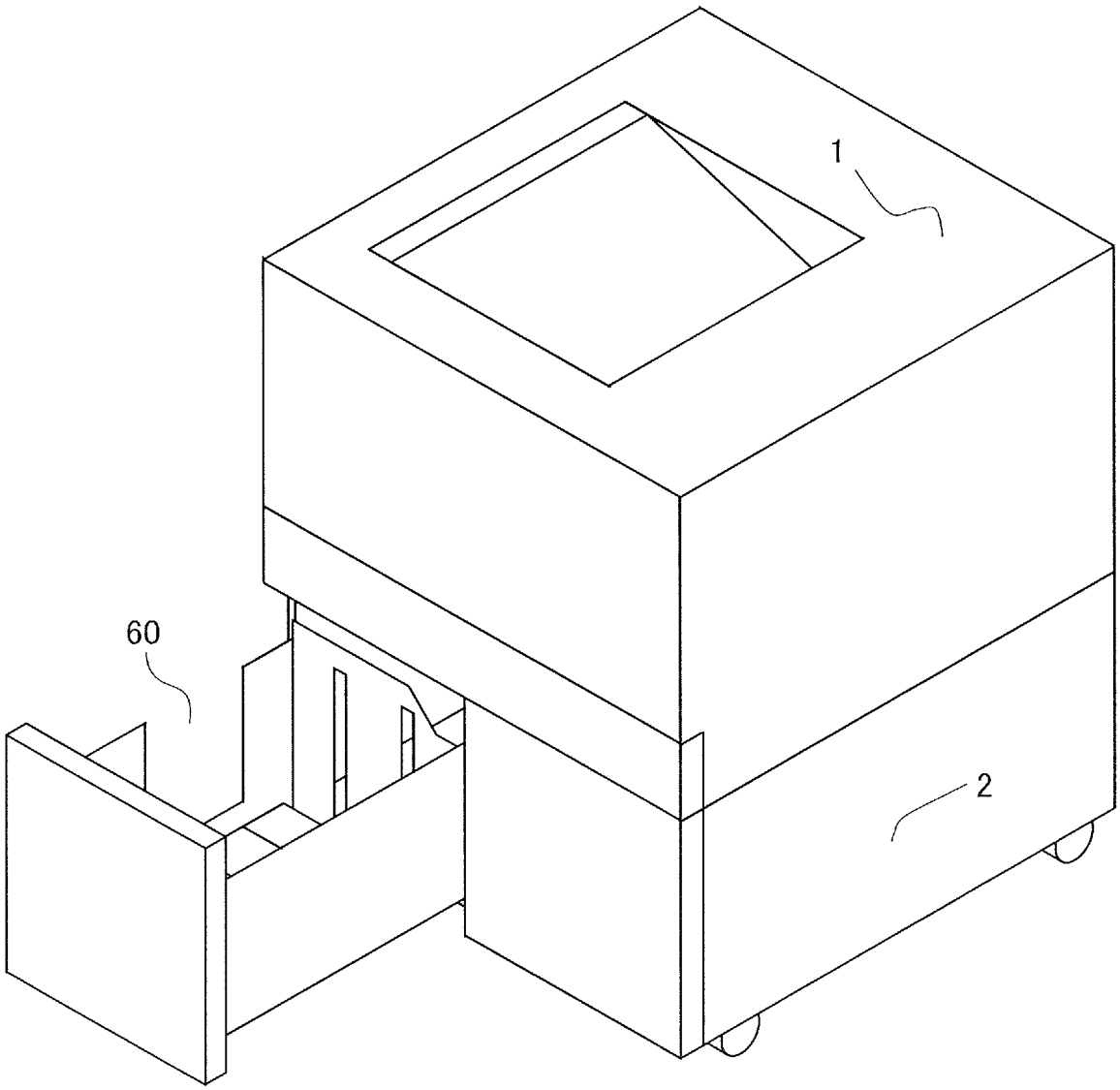
FIG. 2 is an upper perspective view illustrating the image forming apparatus in a state in which a sheet storage case is pulled out.

As illustrated in FIG. 2, when the sheet is stacked on the sheet stacking base 52, the sheet storage portion 60 is brought into a pulled-out state. At this time, in the sheet stacking base 52, as the connection between the drum gear 68*b* and the drive gear 69 is released, the wires 101 and 102 are unwound by a self-weight of the sheet stacking base 52 and the stacked sheet S. Accordingly, as illustrated in FIG. 3, the sheet stacking base 52 is lowered from a feeding position to the lowermost stacking position where the sheet S is stacked.

When the sheet storage portion 60 is in a storage state of being stored in the apparatus body of the sheet feeding apparatus 2, the drum gear 68*b* and the drive gear 69 are engaged with each other. When the storage state is detected by a sensor that is not illustrated, the lifter motor M starts to be driven under a control of a control unit, which is not illustrated, of the printer 100. Then, a driving force of the lifter motor M is transmitted to the winding drums 67*a* and 67*b*, the wires 101 and 102 are wound, and the lifting portions 52*a*, 52*b*, 52*c*, and 52*d* are lifted up, so that the sheet stacking base 52 starts to be raised.

When the sheet stacking base 52 is raised, the upper surface of the uppermost sheet S stacked on the sheet supporting surface 52A abuts on the flag member 62, and the sheet detection sensor 63 is turned on by movement of the flag member 62, the sheet stacking base 52 is in the feeding position, and the lifter motor M is stopped. The feeding position is a position illustrated in FIG. 5 and is a position where the uppermost sheet of the sheets S stacked on the sheet stacking base 52 can be fed by the pickup roller 54 and can smoothly enter a nip between the feed roller 55 and the retard roller 56. Whenever a feeding signal is sent from the control unit of the printer 100, the pickup roller 54 abuts on the uppermost sheet S and rotates, the uppermost sheet is fed to the nip between the feed roller 55 and the retard roller 56. The feed roller 55 and the retard roller 56 separate and feed the sheets fed by the pickup roller 54 one by one, and send the sheets to the image forming unit 110.

Thereafter, when the sheets S stacked on the sheet stacking base 52 are sequentially fed and the upper surface of the uppermost sheet is lowered, the sheet detection sensor 63 is turned off by the movement of the flag member 62. Then, the control unit that is not illustrated drives the lifter motor M again, and raises the sheet stacking base 52. When the sheet detection sensor 63 is turned on again by the movement of the flag member 62, the sheet stacking base 52 is in the feeding position, and the lifter motor M is stopped.

Adjustment Member for Wire

Next, an adjustment member of the wires 101 and 102 according to the first embodiment will be described. As described above, in the sheet stacking base 52, as illustrated in FIG. 3, the lifting portions 52*a*, 52*b*, 52*c*, and 52*d* are suspended by the wires 101 and 102 that are linear members. As the wires 101 and 102 are wound on the winding drums 67*a* and 67*b*, the sheet stacking base 52 is raised, and as the wires 101 and 102 are unwound from the winding drums 67*a* and 67*b*, the sheet stacking base 52 is lowered. That is, the sheet stacking base 52 is configured to be moved (elevated) in a vertical direction.

As illustrated in FIG. 3, a central cover 105 is disposed at the center of the sheet stacking base 52 in the sheet width direction, and as illustrated in FIG. 4, two adjustment members 103A and 103B are arranged inside the central cover 105. The adjustment member 103A is disposed downstream of the adjustment member 103B in the sheet feeding direction, and is configured to adjust an installation position of the wire 101 with respect to the sheet stacking base 52. The adjustment member 103B is disposed upstream of the adjustment member 103A in the sheet feeding direction, and is configured to adjust an installation position of the wire 102 with respect to the sheet stacking base 52. Since the two adjustment members 103A and 103B have the same configuration, in the following description, a configuration of the adjustment member 103A with respect to the wire 101 will be described as an example.

Figure 6:
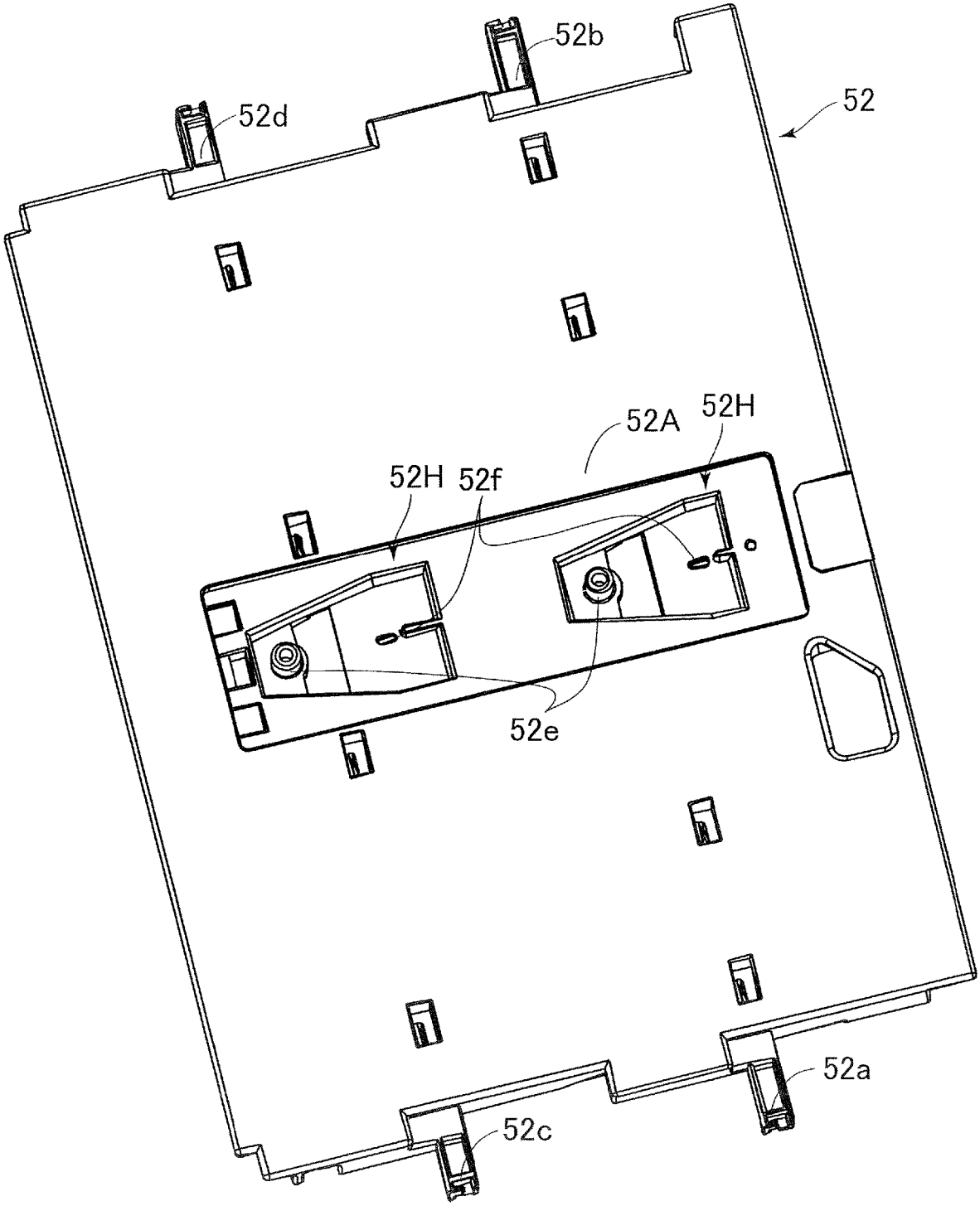
FIG. 6 is an upper perspective view illustrating the sheet stacking base according to the first embodiment.
Figure 7:
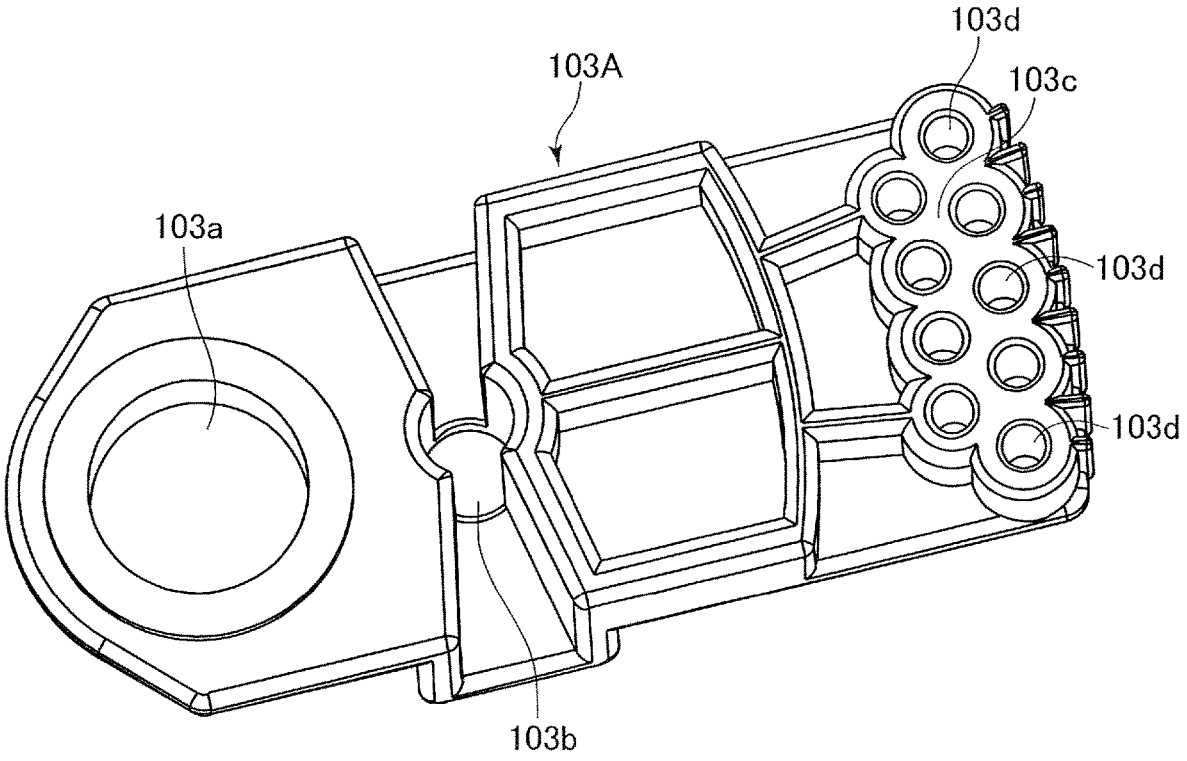
FIG. 7 is an upper perspective view illustrating a relative distance adjustment member according to the first embodiment.

As illustrated in FIG. 6, the sheet stacking base 52 is provided with two hole portions 52H for arranging the adjustment members 103A and 103B, and each of the hole portions 52H is provided with a shaft portion 52*e* extending upward in the sheet stacking direction and a long rounded hole 52*f*. On the other hand, as illustrated in FIG. 7, the adjustment member 103A has a rotation hole portion 103*a*, an engagement hole 103*b*, and a fixing portion 103*c* fixed by a pin 104, and a plurality of through-holes 103*d* are formed through the fixing portion 103*c*.

Figure 8:
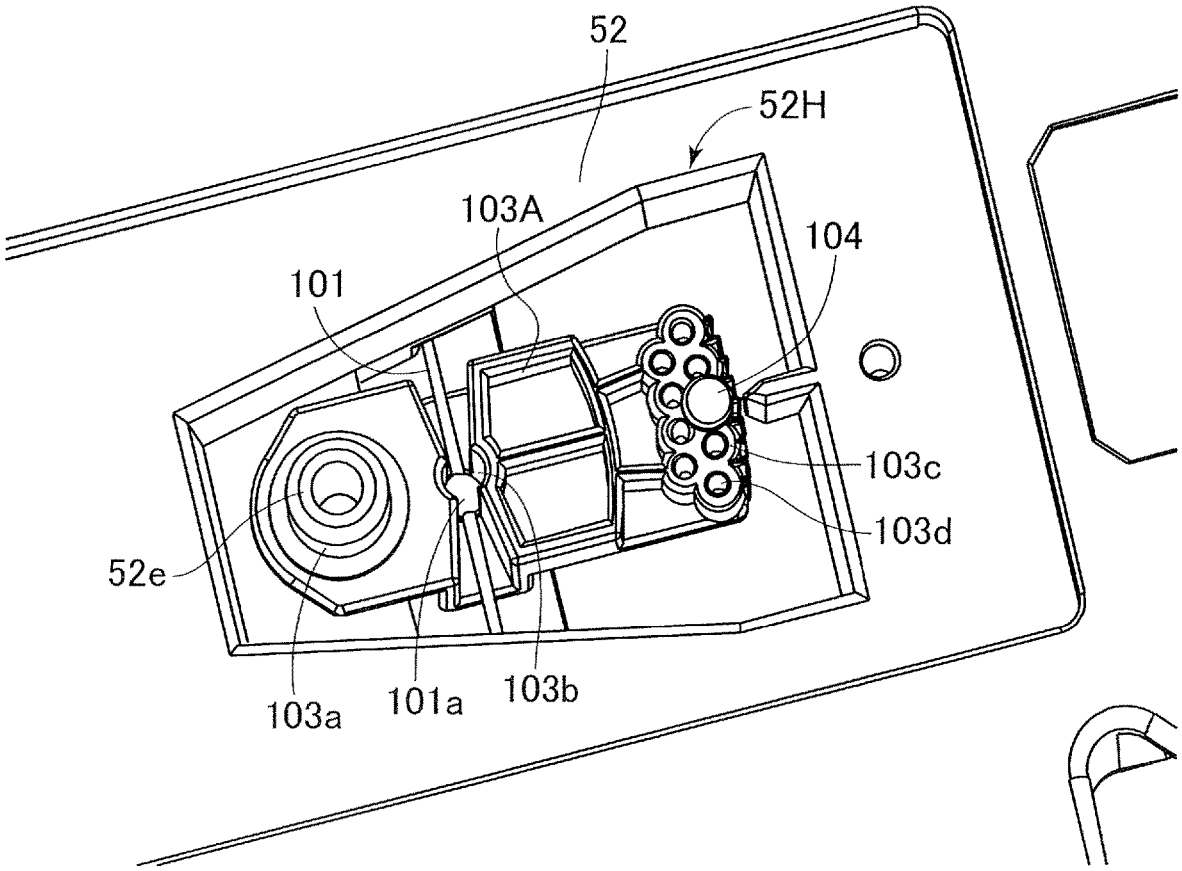
FIG. 8 is an upper perspective view illustrating the relative distance adjustment member fixed to the sheet stacking base according to the first embodiment.

As illustrated in FIG. 8, the rotation hole portion 103*a* of the adjustment member 103A is rotatably engaged with the shaft portion 52*e* provided in the hole portion 52H of the sheet stacking base 52. Further, the engagement hole 103*b* as an engagement portion of the adjustment member 103A is engaged with a caulking ball 101*a* as a fixture that is caulked at a substantially center of the wire 101 in the sheet width direction. Then, the pin 104 is inserted through the through-hole 103*d* of the fixing portion 103*c* and, at the same time, the pin 104 is inserted into the long rounded hole 52*f*, so that the position of the adjustment member 103A with respect to the shaft portion 52*e* in a rotational direction is fixed.

That is, by selectively inserting and fixing the pin 104 that is a penetration member in any one of the plurality of through-holes 103*d*, the posture of the adjustment member 103A with respect to the shaft portion 52*e* in a rotational direction is fixed in a changeable manner. Since the position of the engagement hole 103*b* in the sheet width direction is determined based on the posture of thee adjustment member 103A in the rotational direction, the position of the caulking ball 101*a* in the sheet width direction is determined based on the through-hole 103*d* into which the pin 104 is inserted. That is, the position of a portion of the wire 101 caulked to the caulking ball 101*a* in the sheet width direction is determined based on the through-hole 103*d* into which the pin 104 is inserted. In the present embodiment, by shifting the through-hole 103*d* into which the pin 104 is inserted by one, the position of the caulking ball 101*a* can be moved by 0.5 mm in the sheet width direction.

Figure 9A:
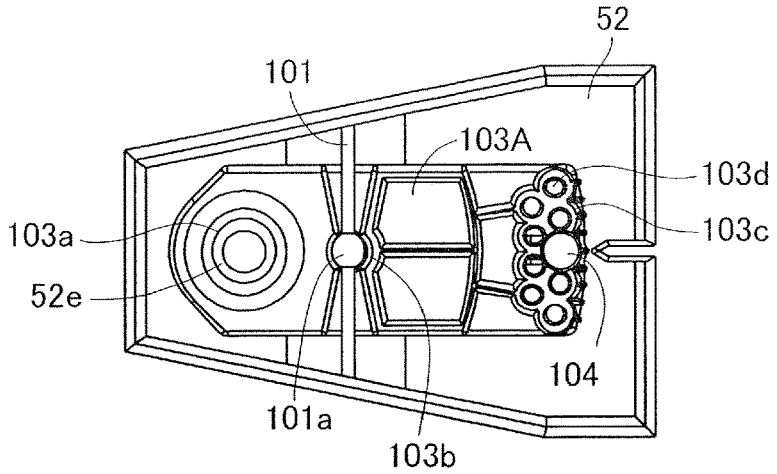
FIG. 9A is a diagram illustrating a case where the relative distance adjustment member is fixed at the center.

When component accuracy of the sheet stacking base 52, the wires 101 and 102, and the pulleys 71*a*, 71*b*, 71*c*, and 71*d* that support them is satisfactory and there is no problem, as illustrated in FIG. 9A, the pin 104 is inserted into a central through-hole 103*d* among the plurality of through-holes 103*d*. Accordingly, the sheet supporting surface 52A of the sheet stacking base 52 becomes substantially horizontal.

Figure 9B:
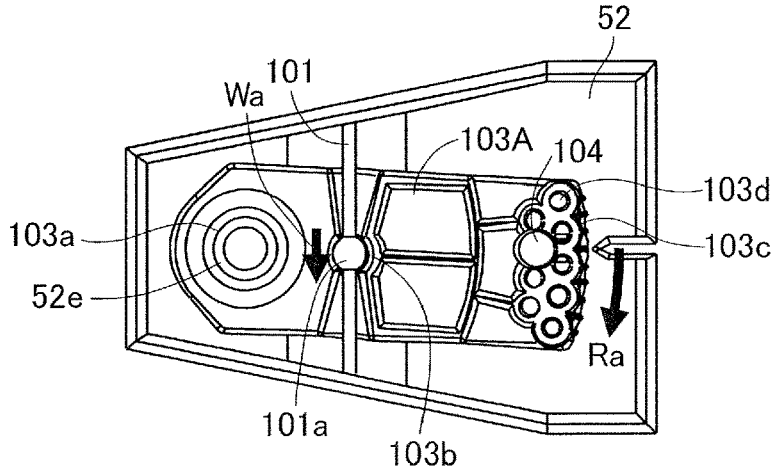
FIG. 9B is a diagram illustrating a case where the relative distance adjustment member is fixed at a position moved from the center by one step to one side.

As illustrated in FIG. 9B, when the through-hole 103*d* into which the pin 104 is inserted is incorporated in a state shifted by one, the adjustment member 103A is rotated in a direction of arrow Ra of the drawing with respect to the sheet stacking base 52. At this time, the caulking ball 101*a* of the wire 101 is configured to be moved by 0.5 mm in a direction of arrow Wa in the drawing by one through-hole 103*d*. Then, a distance (the second distance) of the wire 101 from the lifting portion 52*b* illustrated in FIG. 4 to the winding drum 67*b* is decreased by 0.5 mm, and a distance (first distance) of the wire 101 from the lifting portion 52*a* to the winding drum 67*a* is increased by 0.5 mm. In other words, as for the wire length extending from the sheet stacking base 52, in a state of FIG. 9B as compared to a state of FIG. 9A, the rear side of the device is decreased by 0.5 mm, and the front side of the device is increased by 0.5 mm. Accordingly, the lifting portion 52*b* is higher than the lifting portion 52*a* by 1 mm, and an inclination of the sheet stacking base 52 is adjusted by 1 mm. It can be said that the adjustment member 103A (103B) is a double-sided adjustment tool that adjusts both the first distance and the second distance of the wires 101 and 102 on both sides of the sheet stacking base 52 in the sheet width direction by one adjustment.

Figure 9C:
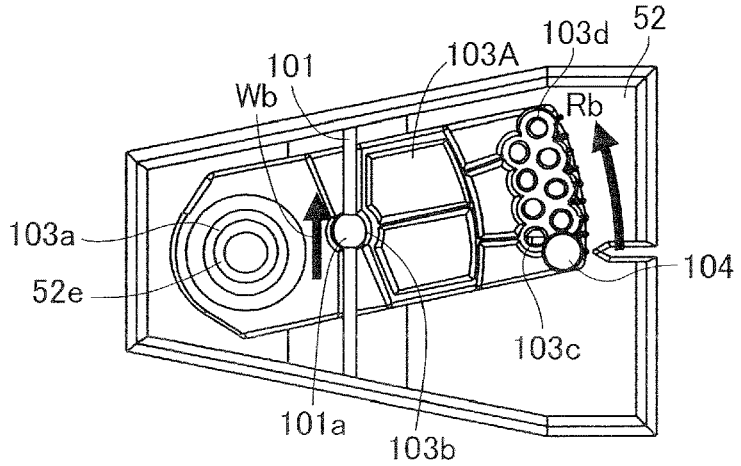
FIG. 9C is a diagram illustrating a case where the relative distance adjustment member is fixed at a position moved from the center to the maximum to the other side.

Further, in the present embodiment, the four through-holes 103*d* are provided on each of both sides from the pin 104 at a central position illustrated in FIG. 9A. As illustrated in FIG. 9C, in a state of being shifted to the maximum in a direction of arrow Rb in the drawing, the fixing portion 103*c* is fixed and attached by the pin 104, so that the caulking ball 101*a* is moved by 2 mm to the maximum in a direction of arrow Wb. In short, in the present embodiment, regarding the heights of the lifting portion 52*b* and the lifting portion 52*a*, for example, when one of the lifting portion 52*b* and the lifting portion 52*a* is moved by +2 mm to the maximum and the other one thereof is moved by −2 mm to the maximum. Thus, the height difference between the lifting portion 52*b* and the lifting portion 52*a* can be adjusted to 4 mm to the maximum.

As described above, a relative distance between the wires 101 and 102 on one side and the other side of the sheet stacking base 52 in the sheet width direction can be adjusted by the adjustment members 103A and 103B. Accordingly, for example, when the heights of both ends of the sheet stacking base 52 in a width direction are different from each other due to variations in the lengths of the sheet stacking base 52 and the wires 101 and 102, variations in the other component dimensions, and the like, the heights of both ends of the sheet stacking base 52 can be adjusted to be equal to each other. In short, the sheet stacking base 52 can be adjusted to be horizontal without managing the component accuracy with high accuracy. Thus, feeding failure and an oblique movement occurring when one end portion of the sheet S becomes high can be reduced. Further, since the sheet stacking base 52 can be adjusted to be horizontal, there is no need to dispose the sheet feeding unit 53 in a high position in order to make a space, and the sheet feeding apparatus 2 or the printer 100 can be downsized in a height direction.

Second Embodiment

Figure 10:
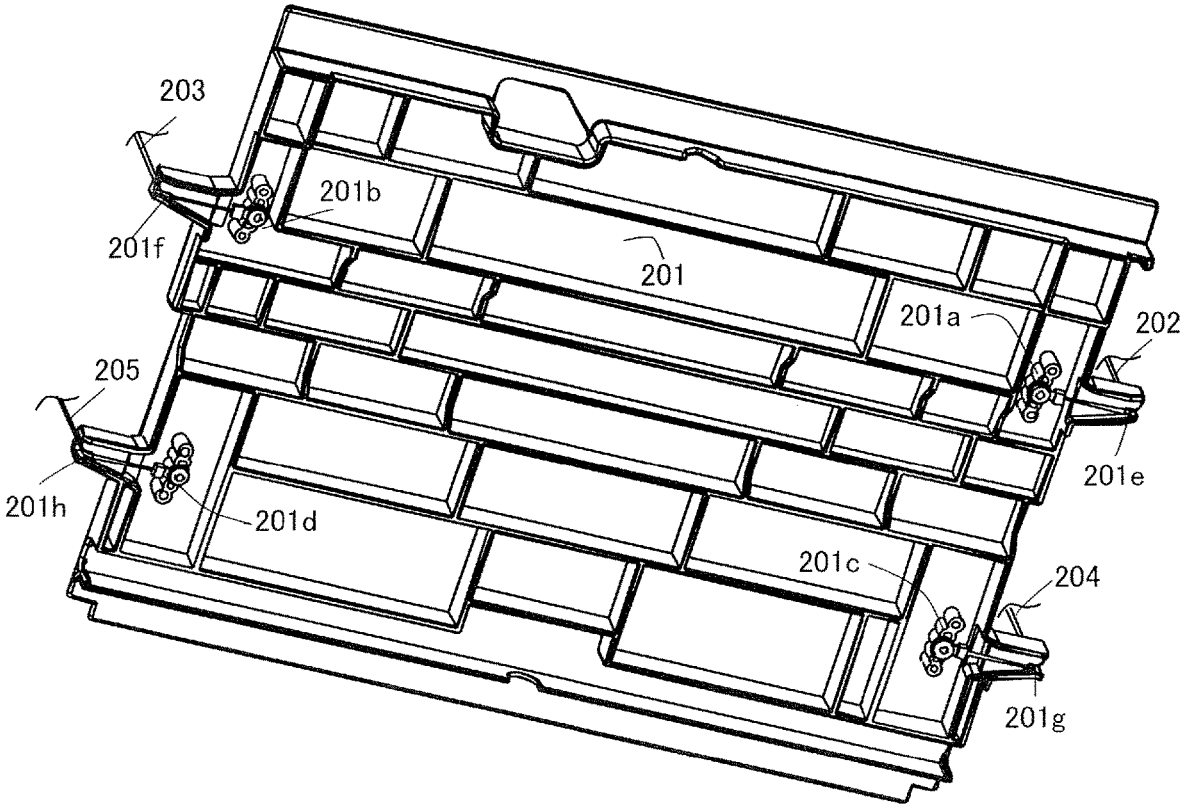
FIG. 10 is a lower perspective view illustrating a sheet stacking base according to a second embodiment.

Next, a second embodiment obtained by partially changing the first embodiment will be described with reference to FIGS. 10 and 11. In description of the second embodiment, the same reference numerals are used for the same components as in the first embodiment, and description thereof will be omitted.

In the first embodiment, it has been described that the sheet stacking base 52 is lifted up by the two wires 101 and 102. Instead, in the sheet feeding apparatus 2 according to the second embodiment, as illustrated in FIG. 10, a sheet stacking base 201 as a sheet stacking portion is lifted up by four wires 202, 203, 204, and 205. In detail, the sheet stacking base 201 is provided with four lifting portions 201*e*, 201*f*, 201*g*, and 201*h*, and the lifting portions 201*e*, 201*f*, 201*g*, and 201*h* are lifted up by independent four wires 202, 203, 204, and 205.

On the lower surface of the sheet stacking base 201 (below the sheet supporting surface), wire fixing portions 201*a*, 201*b*, 201*c*, and 201*d* are provided near the lifting portions 201*e*, 201*f*, 201*g*, and 201*h*, respectively. The wire fixing portions 201*a* and 201*c* are one-side fixing portions (first and third fixing portions) for adjusting a distance between the wires 202 and 204 on a side of the winding drum 67*a*, that is, on one side of the sheet stacking base 52 in the sheet width direction. The wire fixing portions 201*b* and 201*d* are the other-side fixing portions (second and fourth fixing portions) for adjusting a distance between the wires 203 and 205 on a side of the winding drum 67*b*, that is, on the second of the sheet stacking base 52 in the sheet width direction. Thus, the wires 202 and 204 are first linear members on a first side of the sheet stacking base 52 in the sheet width direction, and the wires 203 and 205 are the second linear members on the other side of the sheet stacking base 52 in the sheet width direction.

Further, the wire fixing portion 201*a* is a third adjustment member downstream of the wire fixing portion 201*c* in the sheet feeding direction, and the wire fixing portion 201*b* is a fourth adjustment member downstream of the wire fixing portion 201*d* in the sheet feeding direction. In contrast, the wire fixing portion 201*c* is a first adjustment member upstream of the wire fixing portion 201*a* in the sheet feeding direction, and the wire fixing portion 201*d* is a second adjustment member upstream of the wire fixing portion 201*b* in the sheet feeding direction. Thus, the wire 202 is a third linear member downstream of the wire 204 in the sheet feeding direction, and the wire 203 is a fourth linear member downstream of the wire 205 in the sheet feeding direction. In contrast, the wire 204 is a first linear member upstream of the wire 202 in the sheet feeding direction, and the wire 205 is a second linear member upstream of the wire 203 in the sheet feeding direction. Since the four wire fixing portions 201*a*, 201*b* 201*c*, and 201*d* have the same configuration, the wire fixing portion 201*a* that fixes the wire 202 will be described as an example.

Figure 11A:
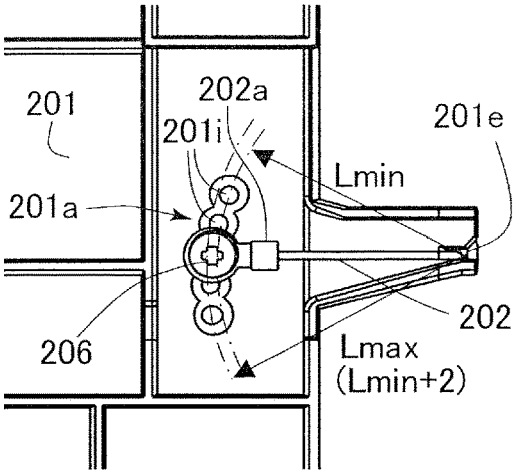
FIG. 11A is a diagram illustrating a case where an end portion position adjustment member is fixed at the center.

As illustrated in FIG. 11A, a screw terminal 202*a* is caulked at an end portion of the wire 202, and the screw terminal 202*a* is substantially configured as the end portion of the wire 202. On the other hand, the wire fixing portion 201*a* of the sheet stacking base 201 is provided with screw holes 201*i* that are five insertion holes set to have different distances from an end portion of the lifting portion 201*e*. Screws 206 as insertion members are arranged through and fastened to the screw holes 201*i*.

Figure 11B:
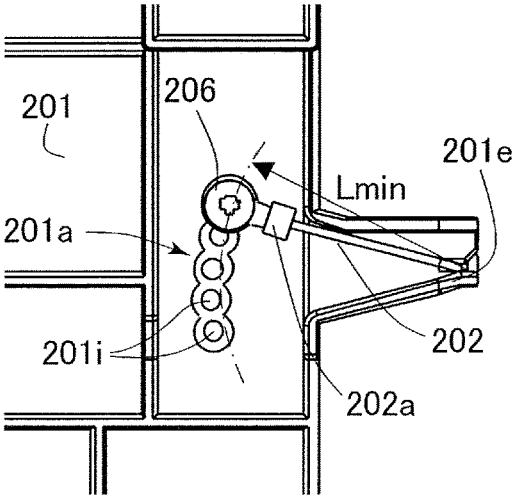
FIG. 11B is a diagram illustrating a case where the end portion position adjustment member is fixed at a position moved from the center to the maximum to one side.
Figure 11C:
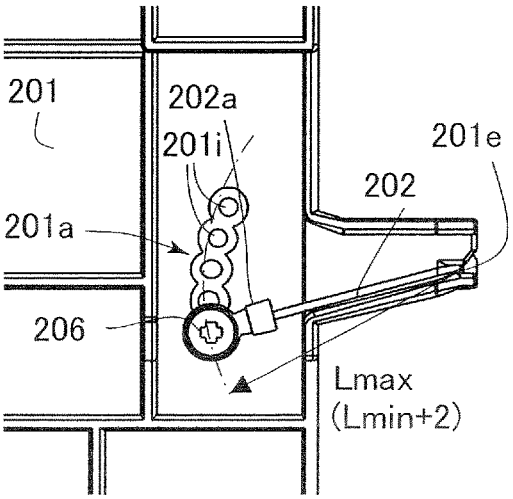
FIG. 11C is a diagram illustrating a case where the end portion position adjustment member is fixed at a position moved from the center to the maximum to the other side.

As illustrated in FIG. 11B, a distance from the screw terminal 202*a* to the lifting portion 201*e* when the screw terminal 202*a* is attached to, with the screw 206, the screw hole 201*i* closest to the lifting portion 201*e* among the five screw holes 201*i* is set as Lmin. On the other hand, as illustrated in FIG. 11C, the distance from the screw terminal 202*a* to the lifting portion 201*e* when the screw terminal 202*a* is attached to, with the screw 206, the screw hole 201*i* farthest from the lifting portion 201*e* among the five screw holes 201*i* is set as Lmax. A difference between the distance Lmin and the distance Lmax is 2 mm. That is, when the position of the screw terminal 202*a* with respect to the screw hole 201*i* is shifted by one, a distance between the lifting portion 201*e* and the screw hole 201*i* is changed by 0.5 mm.

Therefore, when the position of the screw terminal 202*a* with respect to the screw hole 201*i* is shifted by one, a distance (the second distance) of the wire 202 from the lifting portion 201*e* to the winding drum 67*b* is changed by 0.5 mm. In other words, a wire length extending from the sheet stacking base 201 is changed by 0.5 mm. Therefore, the height of the lifting portion 201*e* can be changed by 0.5 mm.

In the second embodiment, since there are the same wire fixing portions 201*a*, 201*b*, 201*c*, and 201*d* in the lifting portions 201*e*, 201*f*, 201*g*, and 201*h*, respectively, the heights of the lifting portions 201*e*, 201*f*, 201*g*, and 201*h* can be adjusted to 2 mm to the maximum.

Thus, even in the second embodiment, relative distances between the wires 202, 203, 204, and 205 on one side and the other side of the sheet stacking base 201 in the sheet width direction can be adjusted. Accordingly, for example, when the heights of both ends of the sheet stacking base 201 in the width direction are different from each other due to the sheet stacking base 201, a variation in the length of each wire, variations in other component dimensions, and the like, the heights of both ends of the sheet stacking base 201 can be adjusted to be equal to each other. Further, in the second embodiment, the heights of the respective lifting portions 201*e*, 201*f*, 201*g*, and 201*h* can be adjusted independently. Thus, the sheet stacking base 201 can be adjusted to be more finely horizontal without managing the component accuracy with high accuracy.

Third Embodiment

Next, a third embodiment obtained by partially changing the first embodiment will be described with reference to FIGS. 12 to 14. In description of the third embodiment, the same reference numerals are used for the same components as in the first embodiment, and description thereof will be omitted.

In the first embodiment, it has been described that the distances from the lifting portions 52*a*, 52*b*, 52*c*, and 52*d* of the wires 101 and 102 to the winding drums 67*a* and 67*b* are changed by changing the position of the caulking ball (the caulking ball 101*a* (see FIG. 8)). In contrast, in the third embodiment, the positions of caulking balls 302*a* and 303*a* caulked at wires 302 and 303 are maintained in a fixed state. Then, the path lengths of the wires 302 and 303 from the caulking balls 302*a* and 303*a* to lifting portions 301*a*, 301*b*, 301*c*, and 301*d* are changed by adjustment members 304*a*, 304*b*, 304*c*, and 304*d* as adjustment members.

Figure 12:
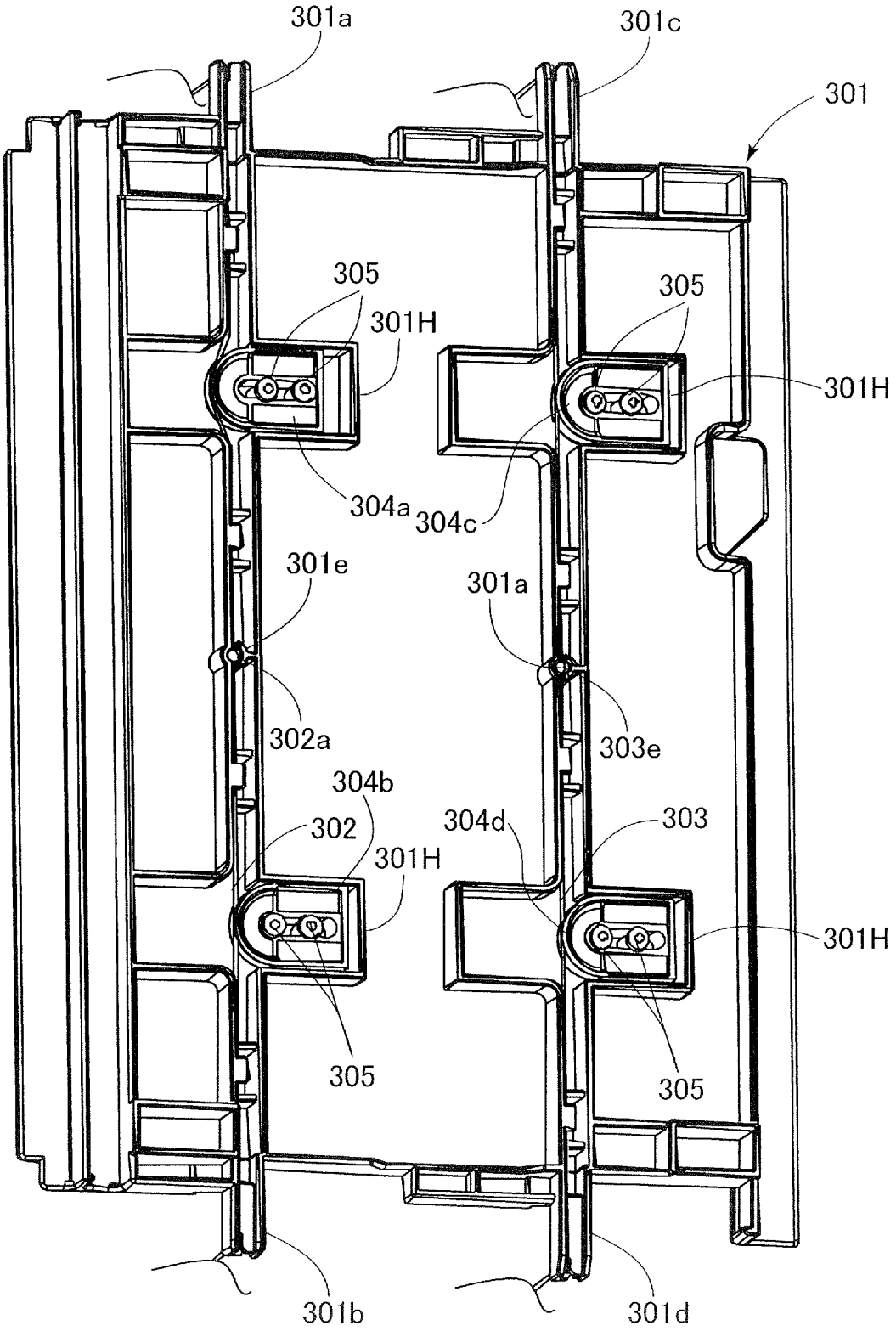
FIG. 12 is a lower perspective view illustrating a sheet stacking base according to a third embodiment.

In detail, as illustrated in FIG. 12, the two wires 302 and 303 are stretched across the lower surface of a sheet stacking base 301 as a sheet stacking portion. Then, the caulking balls 302*a* and 303*a* as fixtures are caulked at substantially the centers of the wires 302 and 303 in the sheet width direction. On the other hand, a caulking ball holding portion 301*e* as two positioning hold portions (first and second positioning hold portions) that hold the caulking balls 302*a* and 303*a* is provided on the lower surface of the sheet stacking base 301. Thus, the wires 302 and 303 are positioned so as not to move in the sheet width direction with respect to the sheet stacking base 301 by the caulking ball holding portion 301*e* provided at a substantially central portion of the sheet stacking base 301.

The four adjustment members 304*a*, 304*b*, 304*c*, and 304*d* between the caulking ball holding portion 301*e* and the lifting portions 301*a*, 301*b*, 301*c*, and 301*d* are arranged on both sides in the sheet width direction, which sandwich the caulking ball holding portion 301*e* of the sheet stacking base 301. That is, the adjustment members 304*a* and 304*c* as first adjustment tools are arranged on a side (one side) where the wires 302 and 303 are wound on the winding drum 67*a* in the sheet width direction with respect to the caulking ball holding portion 301*e*. Further, the adjustment members 304*b* and 304*d* as the second adjustment tools are arranged on a side (the other side) where the wires 302 and 303 are wound on the winding drum 67*b* in the sheet width direction with respect to the caulking ball holding portion 301*e*. Further, the adjustment members 304*a* and 304*b* serve as second adjustment members downstream of the adjustment members 304*c* and 304*d* in the sheet feeding direction. In contrast, the adjustment members 304*c* and 304*d* serve as first adjustment members upstream of the adjustment members 304*a* and 304*b* in the sheet feeding direction. Thus, the wire 302 serves as a second linear member downstream of the wire 303 in the sheet feeding direction. In contrast, the wire 303 serves as a first linear member upstream of the wire 302 in the sheet feeding direction. Further, in the present embodiment, the adjustment member 304*c* constitutes a first adjustment member, and the adjustment member 304*a* constitutes a third adjustment member. Further, the adjustment member 304*d* constitutes a second adjustment member, and the adjustment member 304*b* constitutes a third adjustment member. Since the four adjustment members 304*a*, 304*b*, 304*c*, and 304*d* have the same configuration, a configuration of the one adjustment member 304*a* with respect to the wire 302 will be described as an example.

Figure 13:
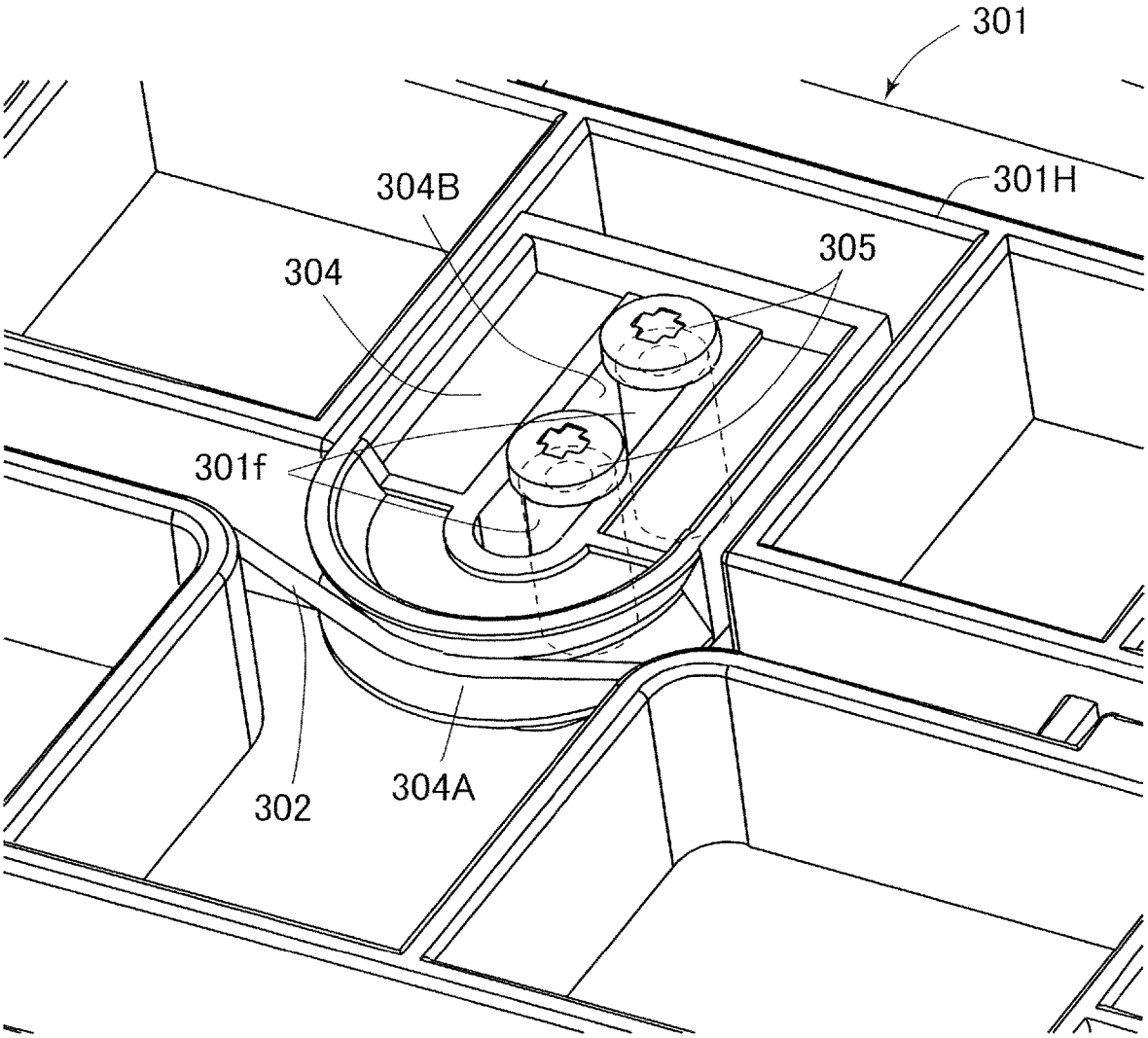
FIG. 13 is an enlarged lower perspective view illustrating a path length adjustment member fixed to the sheet stacking base according to the third embodiment.

As illustrated in FIG. 13, an installation hole 301H for slidably installing the adjustment member 304*a* is formed on the lower surface of the sheet stacking base 301, and two attachment portions 301*f* are arranged in the installation hole 301H. On the other hand, the adjustment member 304*a* has a wire rail portion 304A abutting on the wire 302 and a slot 304B slidably engaged with the attachment portions 301*f*. The adjustment member 304*a* is fixed to the sheet stacking base 301 by fastening screws 305 to the attachment portions 301*f* in a state in which the two attachment portions 301*f* are engaged with the slot 304B.

Figure 14A:
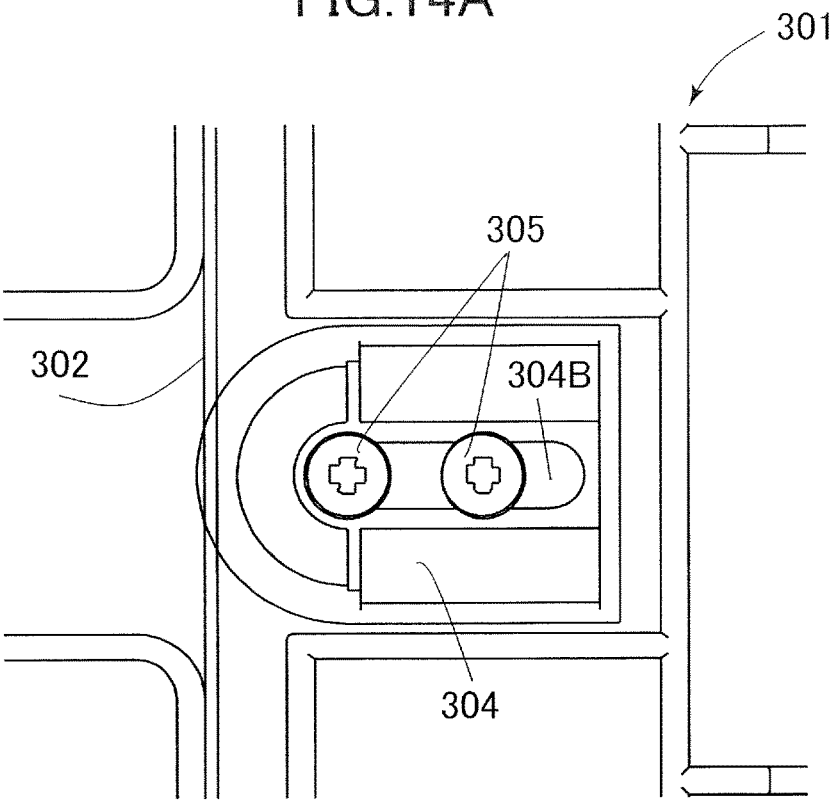
FIG. 14A is a diagram illustrating a case where the path length adjustment member is fixed at a retracting position.
Figure 14B:
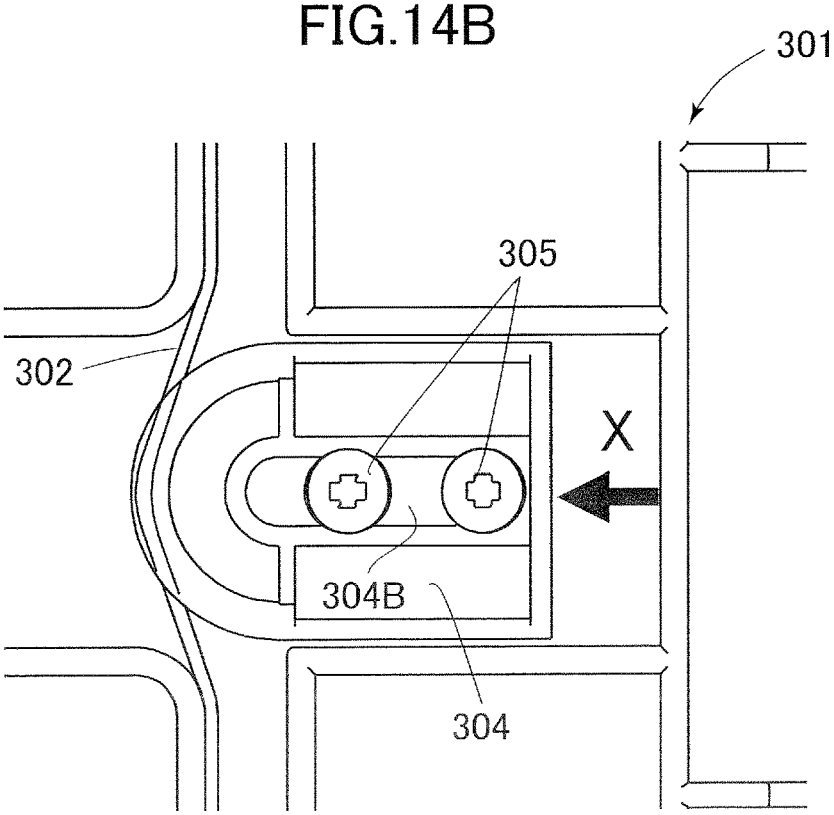
FIG. 14B is a diagram illustrating a case where the path length adjustment member is fixed at an advancing position.

As illustrated in FIGS. 14A and 14B, the adjustment member 304*a* is slid in a direction of arrow X to bypass a path of the wire 302, and performs adjustment of changing a path length between the caulking ball holding portion 301*e* and the lifting portion 301*a* in the wire 302. In the third embodiment, the adjustment member 304*a* is configured to be movable by 5 mm to the maximum in an X direction, and to change a path length of the wire 302 by about 1.5 mm. Thus, a distance (the second distance) of the wire 302 from the lifting portion 301*a* to the winding drum 67*a* can be changed by 1.5 mm to the maximum. Since the adjustment members 304*a*, 304*b*, 304*c*, and 304*d* are arranged at four locations as described above, the heights of the lifting portions 301*a*, 301*b*, 301*c*, and 301*d* can be changed by 1.5 mm to the maximum.

Thus, even in the third embodiment, a relative distance between the wires 302 and 303 on one side and the other side of the sheet stacking base 301 in the sheet width direction can be adjusted. Accordingly, for example, when the heights of both ends of the sheet stacking base 301 in the width direction are different from each other due to the sheet stacking base 301, a variation in the length of each wire, variations in other component dimensions, and the like, the heights of both ends of the sheet stacking base 301 can be adjusted to be equal to each other. Further, in the third embodiment, the heights of the respective lifting portions 301*a*, 301*b*, 301*c*, and 301*d* can be adjusted independently. Thus, the sheet stacking base 301 can be adjusted to be more finely horizontal without managing the component accuracy with high accuracy.

Possibility of Other Embodiments

In the first to third embodiments described above, it has been described that the lifting portions are provided at four locations, so that the sheet stacking base can be raised horizontally. However, the present invention is not limited thereto. A structure in which a first end of the sheet stacking base serves as a pivot fulcrum and a second end thereof is raised may be employed. In this case, one lifting portion (two lifting portions) in the sheet feeding direction may be lifted up by one wire (two wires in the sheet width direction).

Further, in the first to third embodiments, it has been described that the printer body 1 and the sheet feeding apparatus 2 are configured separately. However, in the image forming apparatus in which these components are integrally configured, the sheet storage portion may be configured as a so-called cassette.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-246301, filed Dec. 27, 2018, which is hereby incorporated by reference herein in its entirety.

What is claimed is:

1. A sheet feeding apparatus comprising:

a sheet accommodating unit configured to elevatably support a sheet stacking portion having a stacking surface on which a sheet is stacked;

a sheet feeding unit configured to feed the sheet stacked on the sheet stacking portion;

a first lifting mechanism provided in the sheet stacking portion and disposed on one side in a sheet width direction perpendicular to a sheet feeding direction;

a second lifting mechanism provided in the sheet stacking portion and disposed on the other side in the sheet width direction;

a linear winding member configured to liftably support the first lifting mechanism and the second lifting mechanism, the linear winding member being stretched between the first lifting mechanism and the second lifting mechanism on a lower side of the stacking surface;

a first winding assembly configured to lift the sheet stacking portion by winding the linear winding member supporting the first lifting mechanism;

a second winding assembly configured to lift the sheet stacking portion by winding the linear winding member supporting the second lifting mechanism; and an adjustor having an engagement portion that engages with a fixture fixed to the linear winding member on the lower side of the stacking surface and is movable to a plurality of different positions in the sheet width direction and a fixing portion that fixes the engagement portion at one of the plurality of positions, and configured to adjust both a first distance of the linear winding member between the first winding assembly and the first lifting mechanism and a second distance of the linear winding member between the second winding assembly and the second lifting mechanism, wherein the fixing portion includes a plurality of through-holes set such that positions of the engagement portion in the sheet width direction are different and a penetration member selectively disposed through one of the plurality of through-holes to positioned the engagement portion in the sheet stacking portion.

2. The sheet feeding apparatus according to claim 1, wherein the linear winding member and the adjustor are a first linear winding member and a first adjustor, respectively, and the sheet feeding apparatus further comprises:

a third lifting mechanism disposed downstream of the first lifting mechanism in the sheet feeding direction;

a fourth lifting mechanism disposed downstream of the second lifting mechanism in the sheet feeding direction;

a second linear winding member configured to liftably support the third lifting mechanism and the fourth lifting mechanism; and a second adjustor configured to adjust both a first distance of the second linear winding member between the first winding assembly and the third lifting mechanism and a second distance of the second linear winding member between the second winding assembly and the fourth lifting mechanism.

3. An image forming apparatus comprising:

the sheet feeding apparatus according to claim 1; and an image forming unit configured to form an image on a sheet fed by the sheet feeding apparatus.

4. A sheet feeding apparatus comprising:

a sheet accommodating unit configured to elevatably support a sheet stacking portion having a stacking surface on which a sheet is stacked;

a sheet feeding unit configured to feed the sheet stacked on the sheet stacking portion;

a first lifting mechanism provided in the sheet stacking portion and disposed on one side in a sheet width direction perpendicular to a sheet feeding direction;

a second lifting mechanism provided in the sheet stacking portion and disposed on the other side in the sheet width direction;

a linear winding member configured to liftably support the first lifting mechanism and the second lifting mechanism, the linear winding member being stretched between the first lifting mechanism and the second lifting mechanism on a lower side of the stacking surface;

a first winding assembly configured to lift the sheet stacking portion by winding the linear winding member supporting the first lifting mechanism;

a second winding assembly configured to lift the sheet stacking portion by winding the linear winding member supporting the second lifting mechanism;

a first adjustor disposed on the lower side of the stacking surface and fixed to the sheet stacking portion on one side in the sheet width direction with respect to a positioning hold portion of the sheet stacking portion, which holds and positions a fixture fixed to the linear winding member, the first adjustor mechanism being configured to change a path length of the linear winding member from the positioning hold portion to the first winding assembly; and a second adjustor fixed to the sheet stacking portion on the other side in the sheet width direction with respect to the positioning hold portion, the second adjustor being configured to change a path length of the linear winding member from the positioning hold portion to the second lifting mechanism, wherein the linear winding member is a first linear winding member, and the sheet feeding apparatus further comprises:

a third lifting mechanism disposed downstream of the first lifting mechanism in the sheet feeding direction;

a fourth lifting mechanism disposed downstream of the second lifting mechanism in the sheet feeding direction;

a second linear winding member configured to liftably support the third lifting mechanism and the fourth lifting mechanism; and a third adjustor disposed on the lower side of the stacking surface and fixed to the sheet stacking portion on one side in the sheet width direction with respect to a second positioning hold portion of the sheet stacking portion, which holds and positions a fixture fixed to the second linear winding member, the third adjustor being configured to change a path length of the second linear winding member from the second positioning hold portion to the third lifting mechanism; and a fourth adjustor fixed to the sheet stacking portion on the other side in the sheet width direction with respect to the second positioning hold portion, the fourth adjustor being configured to change a path length of the second linear winding member from the second positioning hold portion to the fourth lifting mechanism.

5. A sheet feeding apparatus comprising:

a sheet accommodating unit configured to elevatably support a sheet stacking portion having a stacking surface on which a sheet is stacked;

a sheet feeding unit configured to feed the sheet stacked on the sheet stacking portion;

a first lifting mechanism provided in the sheet stacking portion and disposed on one side in a sheet width direction perpendicular to a sheet feeding direction;

a second lifting mechanism provided in the sheet stacking portion and disposed on the other side in the sheet width direction;

a first linear winding member configured to liftably support the first lifting mechanism and extend to a lower side of the stacking surface of the sheet stacking portion through the first lifting mechanism;

a second linear winding member configured to liftably support the second lifting mechanism and extend to the lower side of the stacking surface of the sheet stacking portion through the second lifting mechanism;

a first winding assembly configured to lift the sheet stacking portion by winding the first linear winding member;

a second winding assembly configured to lift the sheet stacking portion by winding the second linear winding member;

a first fixing portion disposed on the lower side of the stacking surface of the sheet stacking portion and configured to fix an end portion of the first linear winding member to the sheet stacking portion in such a manner that a path length of the first linear winding member from the end portion of the first linear winding member to the first lifting mechanism can change; and a second fixing portion disposed on the lower side of the stacking surface of the sheet stacking portion and configured to fix an end portion of the second linear winding member to the sheet stacking portion in such a manner that a path length of the second linear winding member from the end portion of the second linear winding member to the second lifting mechanism can change, wherein the first fixing portion includes a plurality of insertion holes having different distances from the first lifting mechanism, and an insertion member to which the end portion of the first linear winding member is fixed and which is selectively inserted into one of the plurality of insertion holes, and wherein the second fixing portion includes a plurality of insertion holes having different distances from the second lifting mechanism, and an insertion member to which the end portion of the second linear winding member is fixed and which is selectively inserted into one of the plurality of insertion holes.

6. A sheet feeding apparatus comprising:

a sheet accommodating unit configured to elevatably support a sheet stacking portion having a stacking surface on which a sheet is stacked;

a sheet feeding unit configured to feed the sheet stacked on the sheet stacking portion;

a first lifting mechanism provided in the sheet stacking portion and disposed on one side in a sheet width direction perpendicular to a sheet feeding direction;

a second lifting mechanism provided in the sheet stacking portion and disposed on the other side in the sheet width direction;

a first linear winding member configured to liftably support the first lifting mechanism and extend to a lower side of the stacking surface of the sheet stacking portion through the first lifting mechanism;

a second linear winding member configured to liftably support the second lifting mechanism and extend to the lower side of the stacking surface of the sheet stacking portion through the second lifting mechanism;

a first winding assembly configured to lift the sheet stacking portion by winding the first linear winding member;

a second winding assembly configured to lift the sheet stacking portion by winding the second linear winding member;

a first fixing portion disposed on the lower side of the stacking surface of the sheet stacking portion and configured to fix an end portion of the first linear winding member to the sheet stacking portion in such a manner that a path length of the first linear winding member from the end portion of the first linear winding member to the first lifting mechanism can change;

a second fixing portion disposed on the lower side of the stacking surface of the sheet stacking portion and configured to fix an end portion of the second linear winding member to the sheet stacking portion in such a manner that a path length of the second linear winding member from the end portion of the second linear winding member to the second lifting mechanism can change;

a third lifting mechanism disposed downstream of the first lifting mechanism in the sheet feeding direction;

a fourth lifting mechanism disposed downstream of second lifting mechanism in the sheet feeding direction;

a third linear winding member configured to liftably support the third lifting mechanism;

a fourth linear winding member configured to liftably support the fourth lifting mechanism;

a third fixing portion disposed on the lower side of the stacking surface of the sheet stacking portion and configured to fix an end portion of the third linear winding member to the sheet stacking portion in such a manner that a path length of the third linear winding member from the end portion of the third linear winding member to the third lifting mechanism can change; and a fourth fixing portion disposed on the lower side of the stacking surface of the sheet stacking portion and configured to fix an end portion of the fourth linear winding member to the sheet stacking portion in such a manner that a path length of the fourth linear winding member from the end portion of the fourth linear winding member to the fourth lifting mechanism can change.

* * * * *